US008820498B2

(12) United States Patent
Benshetrit et al.

(10) Patent No.: US 8,820,498 B2
(45) Date of Patent: Sep. 2, 2014

(54) EXPANDABLE SUITCASE

(75) Inventors: Dror Benshetrit, New York, NY (US); Paul V. Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 237 days.

(21) Appl. No.: 13/311,658

(22) Filed: Dec. 6, 2011

(65) Prior Publication Data

US 2013/0140118 A1 Jun. 6, 2013

(51) Int. Cl.
*A45C 7/00* (2006.01)
*A45C 5/03* (2006.01)
*A45C 13/00* (2006.01)

(52) U.S. Cl.
USPC ..... 190/103; 190/107; 220/6

(58) Field of Classification Search
USPC ..... 190/103, 107, 122, 127, 104, 105; 220/6
See application file for complete search history.

(56) References Cited

U.S. PATENT DOCUMENTS 1,573,721 A * 2/1926 Loeffler ..... 190/107
2,002,878 A * 5/1935 Belber ..... 190/103
2,710,084 A * 6/1955 Braverman ..... 190/107
2,798,579 A * 7/1957 Fox ..... 190/122
2,903,033 A * 9/1959 Robinson ..... 190/122
3,450,237 A * 6/1969 Dyke ..... 190/103
3,480,118 A * 11/1969 Dyke ..... 190/103
3,962,010 A * 6/1976 Riou et al. ..... 156/93
4,128,150 A * 12/1978 Popkin et al. ..... 190/103
5,251,731 A * 10/1993 Cassese et al. ..... 190/107
6,401,890 B1 * 6/2002 Tan ..... 190/107
7,195,109 B2 * 3/2007 Mitchell et al. ..... 190/103
7,641,030 B2 * 1/2010 Selvi ..... 190/40

* cited by examiner

*Primary Examiner* — Sue A Weaver
(74) *Attorney, Agent, or Firm* — Lando & Anastasi, LLP

(57) ABSTRACT

In one embodiment of the present invention, an expandable suitcase comprises: a front portion; a back portion; a plurality of side panels, each side panel aligning with one of a top, a bottom, a first side, and a second side of the suitcase, and each side panel having a primary board, at least a first side board rotatably connected to the primary board about a common edge therewith, and a first side flap rotatably connected to the first side board about a common edge opposing the common edge with the primary board; and a plurality of hinges disposed at an intersection of two side panels, each hinge comprising a first hinge panel attached to one of the side panels and a second hinge panel connected to the other side panel, wherein the hinge remains in a substantially planar position in a rested state.

14 Claims, 10 Drawing Sheets

EXPANDABLE SUITCASE

BACKGROUND OF THE INVENTION

1. Field of the Invention

Embodiments of the present invention generally relate to a suitcase, and more generally to luggage and/or travel bags. In particular, embodiments of the present invention relate to expandable suitcases, articles of luggage and/or travel bags, and more particularly to hard-sided expandable suitcases, articles of luggage or the like.

2. Description of the Related Art

The needs of travelers for luggage space can vary considerably, depending on the duration of a trip, the nature of the trip in terms of the types of clothing and other gear required, and the climate of the destination. For example, regardless of the purpose and the climate, a traveler does not need as much luggage space for a trip of short duration as for a long one. Generally, a business traveler does not need as much luggage space as a recreational traveler, especially one who needs both casual and dress clothes. In most cases, men need less luggage space than women.

One way for travelers to provide for both smaller and larger luggage space requirements is to have a moderately sized suitcase for some trips and a large one for other trips. Another way is to have two moderate sized suitcases and use only one when possible and use both when a larger capacity is needed. There have also been various proposals for expandable luggage. An expandable article of luggage offers the traveler a possible savings in cost as compared to the costs of purchasing more than one piece of luggage. Moreover, the capability of expanding a piece of luggage permits a traveler to change the carrying capacity in the course of a trip. Not infrequently, a traveler will make purchases on a trip and will need more room for the return trip than for travel to a destination.

Most currently available luggage having a variable volume is of the "soft" type, such as a duffle bag with expandable sections that can be collapsed and secured to a main section. To the extent expandable "hard" luggage exists, most generally lack rigidity when expanded due to inadequate linking of separate rigid frame components that move away from each other when the luggage is expanded.

The few known articles of hard luggage that possess a rigid expansion portion generally comprise two rigid shells, where one is slidable or extendable from the other. Such type of assembly requires significant manufacturing of slidable tracks or frames to be built into the interior of the luggage often increasing the weight and cost of the luggage. In addition, due to the nature of luggage frequently being dropped, banged, or bumped by airline personnel or the like, such tracks and frames often become dislodged, rending the expandable portion of such luggage useless.

Moreover, all known suitcases and articles of luggage are generally limited to a single expansion stage. That is, the suitcase can either be in an expanded position or a non-expanded position, without a third position/ size.

Thus, there is a need for an improved expandable suitcase and methods thereof.

SUMMARY OF THE INVENTION

Embodiments of the present invention generally relate to a suitcase, and more generally to luggage and/or travel bags. In particular, embodiments of the present invention relate to expandable suitcases, articles of luggage and/or travel bags, and more particularly to hard-sided expandable suitcases, articles of luggage or the like.

In one embodiment of the present invention, an expandable suitcase comprises: a front portion; a back portion; a plurality of side panels, each side panel aligning with one of a top, a bottom, a first side, and a second side of the suitcase, and each side panel having a primary board, at least a first side board rotatably connected to the primary board about a common edge therewith, and a first side flap rotatably connected to the first side board about a common edge opposing the common edge with the primary board; and a plurality of hinges disposed at an intersection of two side panels, each hinge comprising a first hinge panel attached to one of the side panels and a second hinge panel connected to the other side panel, wherein the hinge remains in a substantially planar position in a rested state.

In another embodiment of the present invention, an expandable suitcase comprises: a front portion; a back portion; a plurality of side panels, each side panel aligning with one of a top, a bottom, a first side, and a second side of the suitcase, and each side panel comprising: a primary board; at least a first side board rotatably connected to the primary board about a common edge therewith, and a first side flap rotatably connected to the first side board about a common edge opposing the common edge with the primary board; and a second side board rotatably connected to the primary board about a common edge opposing the common edge between the primary board and the first side board, and a second side flap rotatably connected to the second side board about a common edge opposing the common edge with the primary board; a plurality of hinges disposed at an intersection of two side panels, each hinge comprising a first hinge panel attached to one of the side panels, a second hinge panel connected to the other side panel, a spine for providing an axis about which the first and second hinge panels may rotate, wherein each of the hinges is spring-loaded to hold the hinge in a substantially planar position in a rested state.

In yet another embodiment, a method of expanding a suitcase comprises: providing an expandable suitcase, the expandable suitcase comprising a front portion; a back portion; a plurality of side panels, each side panel aligning with one of a top, a bottom, a first side, and a second side of the suitcase, and each side panel having a primary board, at least a first side board rotatably connected to the primary board about a common edge therewith, and a first side flap rotatably connected to the first side board about a common edge opposing the common edge with the primary board; and a plurality of hinges disposed at an intersection of two side panels, each hinge comprising a first hinge panel attached to one of the side panels and a second hinge panel connected to the other side panel, wherein the hinge remains in a substantially planar position in a rested state; retracting each of the plurality of hinges towards a center of the suitcase; extending each of the first side flaps of each of the plurality of side panels; and releasing the plurality of hinges.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
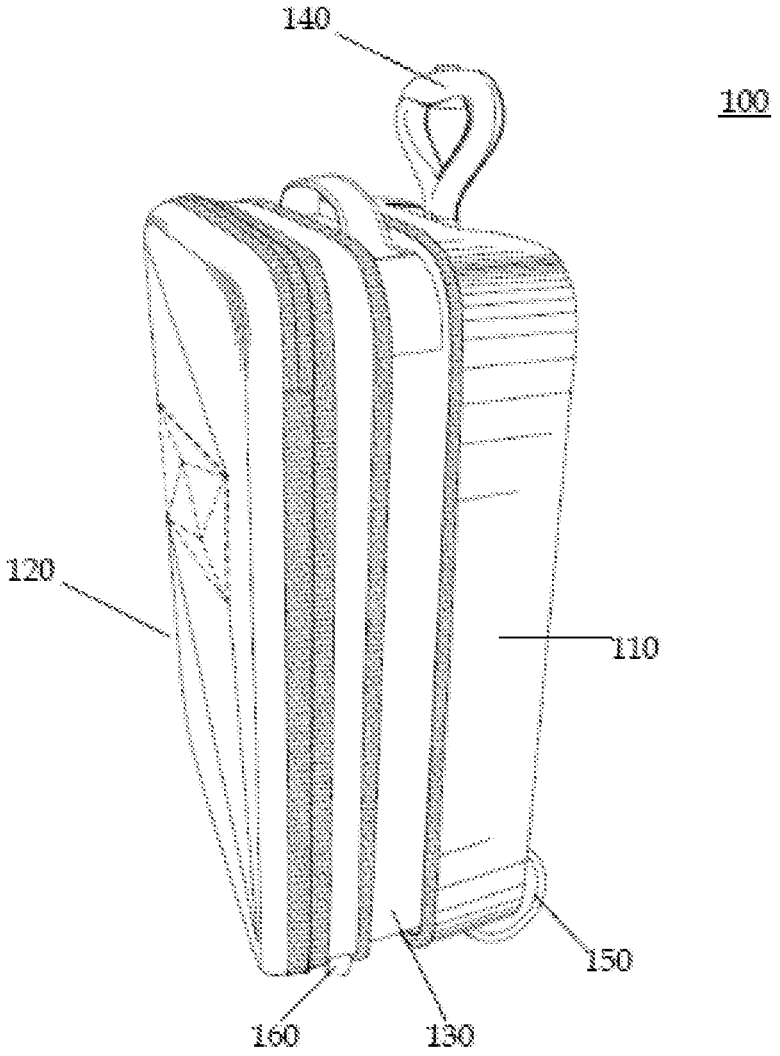
FIG. 1 depicts a perspective view of an expandable suitcase in a collapsed position in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to a suitcase, and more generally to luggage and/or travel bags. In particular, embodiments of the present invention relate to expandable suitcases, articles of luggage and/or travel bags, and more particularly to hard-sided expandable suitcases, articles of luggage or the like.

Embodiments of the present invention may generally be described herein with respect to a hard-sided suitcase for carrying and/or storing different types of articles. As utilized herein, the phrase hard-sided and similar or related terms, are intended to distinguish between rigid or semi-rigid materials (e.g., metals, polymers, etc.) and pliable materials that are substantially incapable of retaining their shape with marginal force applied thereon (e.g., fabric, canvas, etc.). While many embodiments of the present invention are directed to hard-sided suitcases, articles of luggage and bags, any type of voluminous apparatus may be suitable for the structural and functional teachings disclosed herein. In addition, the term "suitcase" or variations thereof should be understood to be inclusive of any type of luggage, bag, briefcase, business case, travel bag or the like.

FIG. 1 depicts a perspective view of an expandable suitcase in a collapsed position in accordance with one embodiment of the present invention. A suitcase 100 generally comprises a back portion 110, a front portion 120, and an expandable portion 130, generally positioned between the front portion 120 and back portion 110. As shown in the Figure, the suitcase 100 may also generally comprise common suitcase elements such as one or more handles 140, wheels 150 and feet 160 for providing stability when in a standing position. Other various common features, such as pockets, zippers, ornamental designs, and the like may also be provided on the suitcase 100.

The front portion 120 and the back portion 110 may each generally comprise a shell, which form one or more storage compartments for the suitcase 100. In many embodiments, the shell comprises a hard-sided shell, although some embodiments may also utilize a pliable material formed about a rigid frame to create the shell. Each shell may comprise any material suitable for embodiments of the present invention.

In many embodiments, the shell comprises one of a thermoplastic material composition or similar composition. In some embodiment, the shell comprises a polycarbonate composition, which may enable the shells to be flexible, while maintaining a generally rigid form. When an external force is applied to the shells, the polycarbonate composition may allow the shells to absorb the impact from the force without cracking or breaking. Alternative embodiments may provide materials such as acrylonitrile butadiene styrene (ABS), ethylene vinyl acetate (EVA), combinations thereof, including combinations utilizing polycarbonate, or the like.

Figure 2:
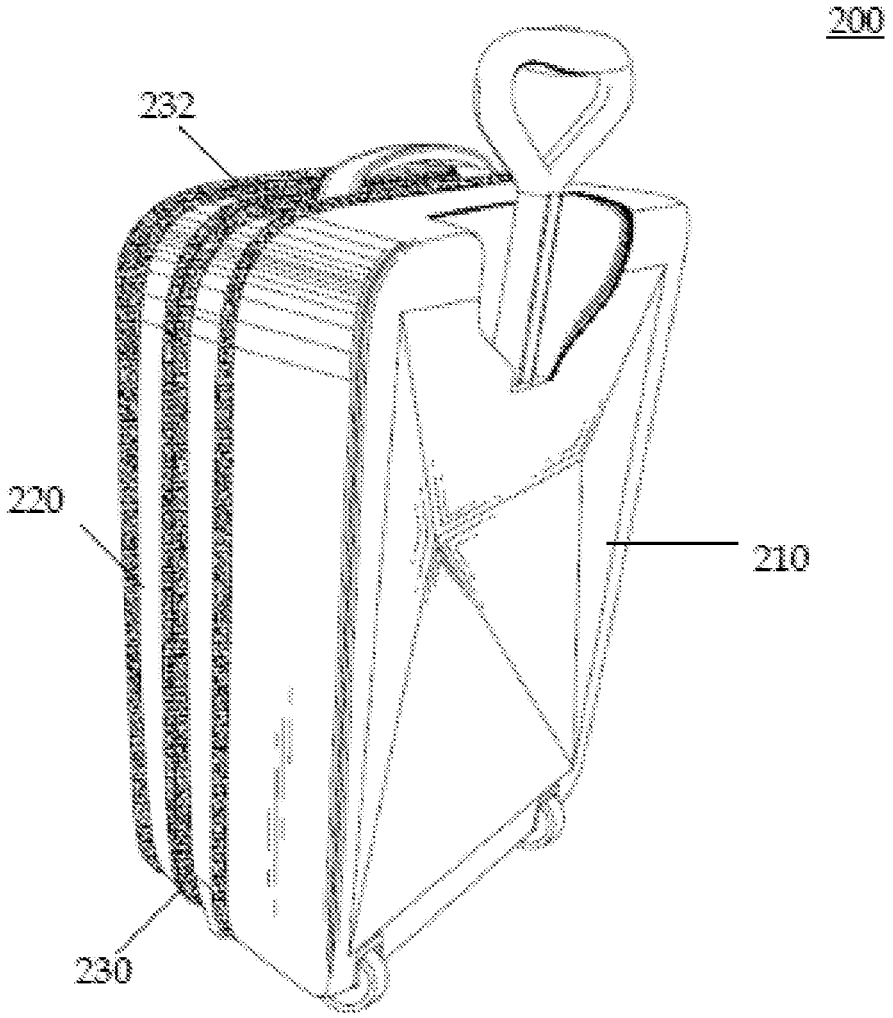
FIG. 2 depicts a perspective view of an expandable suitcase in a collapsed position in accordance with one embodiment of the present invention.

FIG. 2 depicts a side view of an expandable suitcase in a collapsed position in accordance with one embodiment of the present invention. As shown in the Figure, the expandable portion 230 of the suitcase 200 is generally referenced as the region between the front portion 220 and the back portion 210. In many embodiments, the means for opening the suitcase 200, such as a zipper, a latch, a lock, or similar mechanical fastener, is provided along the expandable portion 230. In the embodiment shown in the Figure, the means for opening the suitcase is provided in the form of a zipper 232.

Figure 3:
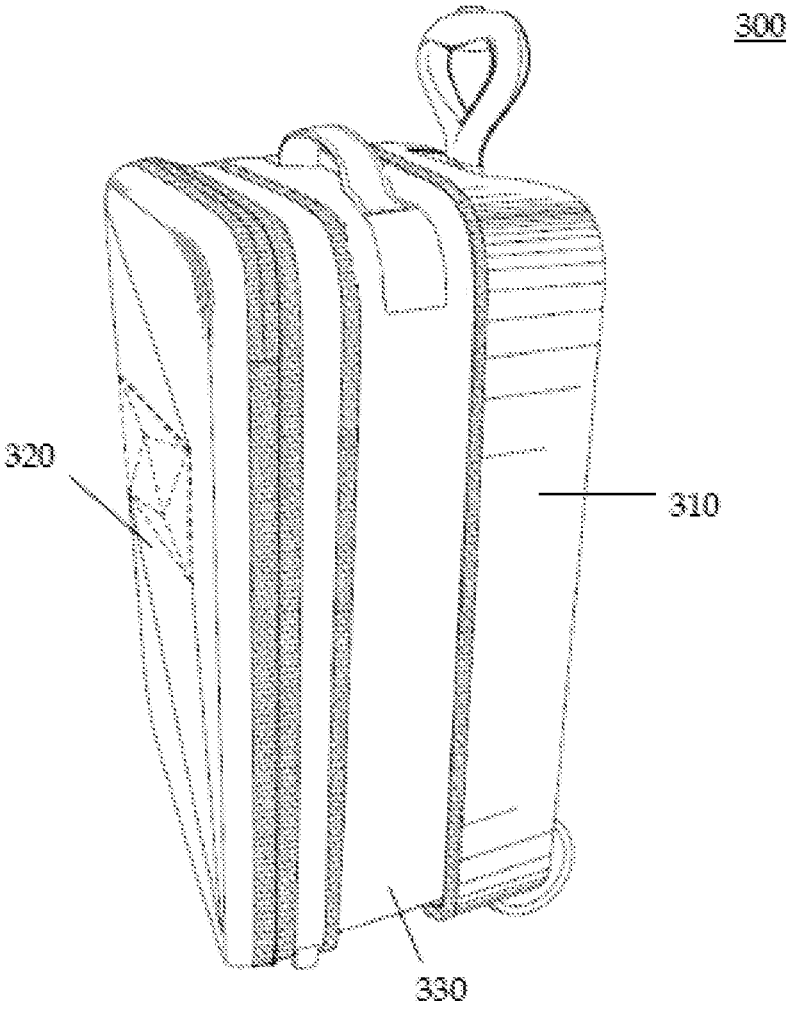
FIG. 3 depicts a perspective view of an expandable suitcase in an expanded position in accordance with one embodiment of the present invention.

FIG. 3 depicts a side view of an expandable suitcase in an expanded position in accordance with one embodiment of the present invention. As shown in the Figure, in an expanded position, the expanded portion 330 of the suitcase 300 may increase in width (i.e., from a back side of the back portion 310 to a front side of the front portion 320) by between about 10% to about 100% of the collapsed width, depending upon the size of the suitcase 300. In many embodiments, the suitcase 300 may expand in width by between about 25% to about 75% of the collapsed width.

Figure 4:
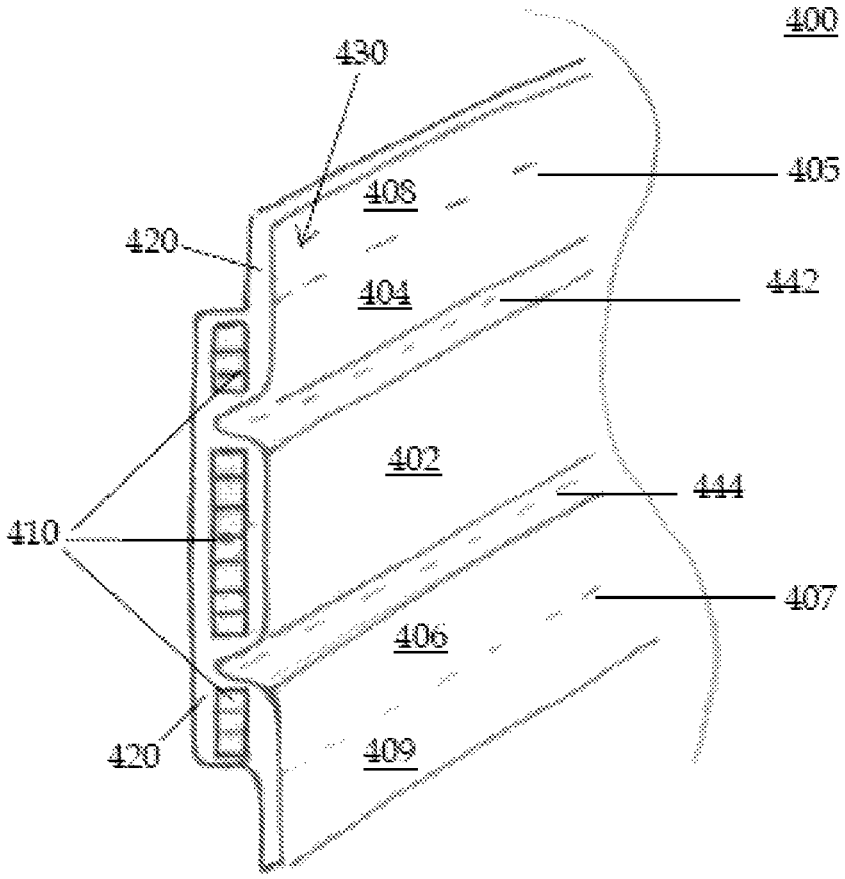
FIG. 4 depicts a cross-sectional perspective view of a side panel in an expanded position in accordance with one embodiment of the present invention.

On the interior of the suitcase, surrounding the top, bottom and side walls thereof, are side panels made in accordance with embodiments of the present invention. FIG. 4 depicts a cross-sectional perspective view of a side panel in an expanded position in accordance with one embodiment of the present invention. For purposes of orientation herein, as shown in the Figure, the surface side visible having reference numerals thereon shall be deemed the front surface, and the opposing side shall be deemed the back surface.

As shown in the Figure, a side panel 400 generally comprises a primary board 402 centered between a first side board 404 and a second side board 406. Extending off of each of the side boards are a first side flap 408 and a second side flap 409, respectively.

In many embodiments, the structure of the side panel 400 may generally comprises a primary support structure 410, a body material 420 and a covering 430 for exposure to an inside surface of suitcase. The primary support structure 410 may generally comprise a durable, substantially rigid material suitable for embodiments of the present invention. In one embodiment, the primary support structure 410 comprises a thermoplastic material, such as polyethylene, polypropylene or the like. In one embodiment, where a strength to weight ratio is concerned, the primary support structure 410 comprises a thermoplastic material formed into a honeycomb shape, or similar structure. Exemplary materials may include ABS, EVA, polycarbonate, combinations thereof, or the like.

The body material 420 may generally comprise any material suitable to surround the primary support structure 410 and form the basis for the functional aspects of the side panel 400 described herein. In many embodiments, the body material 420 comprises a fabric or similar material, suitable to allow the sections of the side panel 400 to bend and fold where appropriate. Alternative embodiments may provide similar materials, such as any woven or nonwoven cloth, canvas, pliable polymers or the like.

The covering 430 may generally comprise any suitable material that is commonly used as a suitcase liner. Such common examples of liners include nylon, polyester, cotton, combinations thereof, or the like.

Once the side panel 400 is assembled, each of the first side board 404 and the second side board 406 may be rotatable about respective common edges 442 and 444 with the primary board 402. In addition, the first side flap 408 is generally rotatable about a common edge 405 with the first side board 404, as will be explained in more detail herein. Similarly, the second side flap 409 is generally rotatable about a common edge 407 with the second side board 406.

Figure 5:
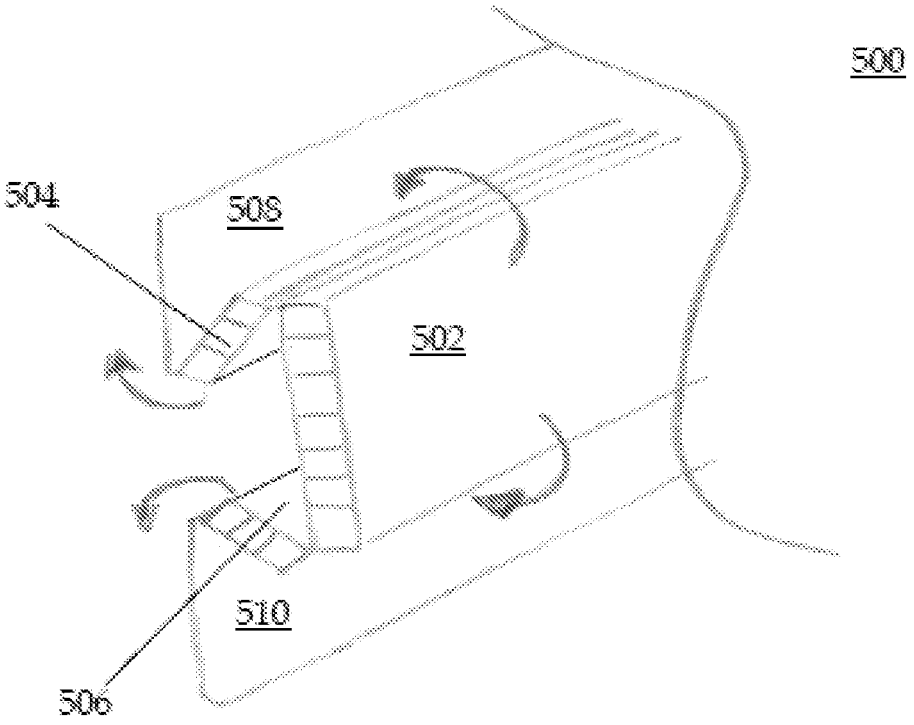
FIG. 5 depicts a cross-sectional perspective view of a side panel in a collapsed position in accordance with one embodiment of the present invention.

FIG. 5 depicts a cross-sectional perspective view of a side panel in a collapsed position in accordance with one embodiment of the present invention. In a collapsed position, the side panel 500 generally has a primary board 502 having a first side board 504 and a second side board 506 rotated back towards a back surface of the primary board 502. As shown, the first side board 504 and the second side board 506 may be rotated down until a back surface of each of the side boards is substantially touching or is close to touching the back surface of the primary board 502.

As shown in the Figure, the first side flap 508 and the second side flap 510 may be rotated about the respective common edges with first side board 504 and the second side board 506, back towards the front surface of primary board. In many embodiments, the first side flap 508 and the second side flap 510 may be rotated until a front surface of each of the side flaps is substantially touching or is close to touching the front surface of each of the respective side boards.

In many embodiments, the first side flap 508 would be affixed to either the front portion or back potion of the suitcase, or similar structural component of the suitcase, and the second side flap 510 would be affixed to the opposing portion. As such, when in use, the back surface of the side panel appears between the front portion and back portion of the suitcase, and is visible as the expandable portion as shown in FIGS. 1-3.

While difficult to ascertain from the Figure alone, in order to modify the side panel 500 from the closed position as shown in the Figure to the open position shown in FIG. 4 above, while holding each of the side flaps in place (e.g., when affixed to a rigid structure such as the front portion or back portion of the suitcase), the primary board 502 must move in an lateral direction (i.e., towards the front and/or back surface) as the side flaps and side boards rotate. Similarly, if both the side flaps and the primary board are substantially held in place (e.g., by some additional mechanism), embodiments of the present invention provide it would be difficult to go from the closed position to the open position as described herein.

In alternative embodiments of the present invention, it should be appreciated that a side panel may be provided with only a primary board, a first side board, and a first side flap. In such an embodiment, a suitcase may still be expandable to the extent the first side board and first side flap are capable of collapsing and opening in a manner similar to that described herein.

Figure 6:
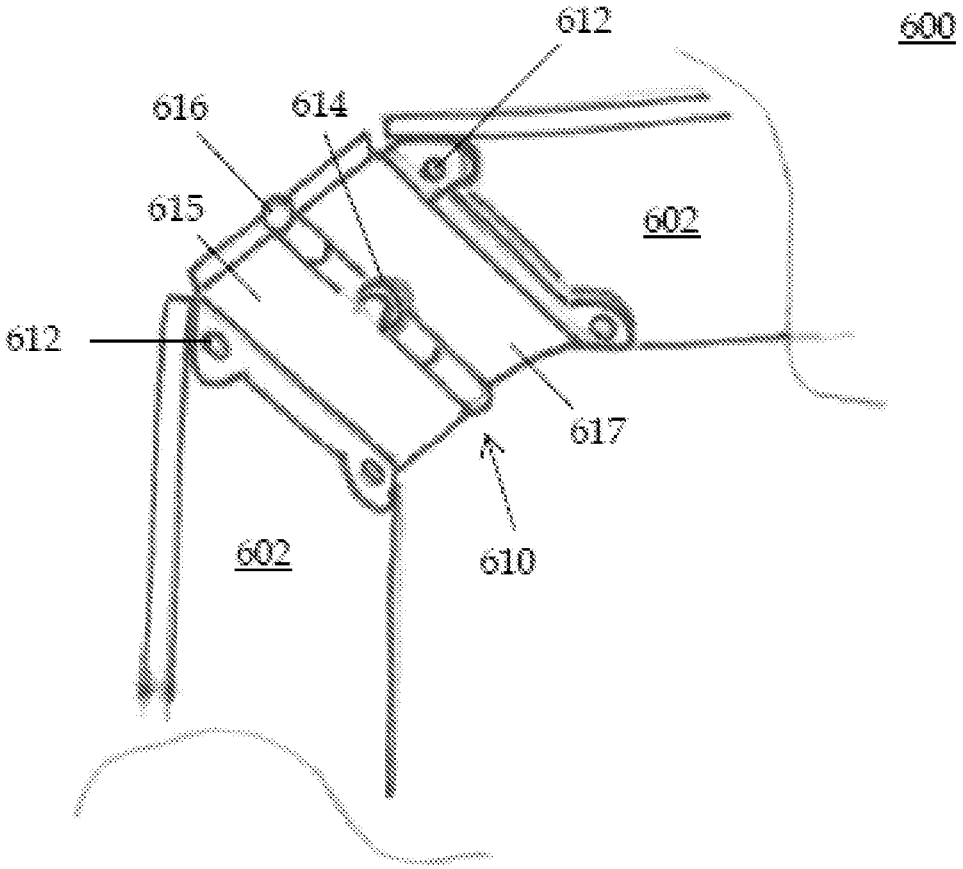
FIG. 6 depicts a perspective view of a corner hinge connected to two side panels in accordance with one embodiment of the present invention.

FIG. 6 depicts a perspective view of a corner hinge connected to two side panels in accordance with one embodiment of the present invention. In accordance with many embodiments of the present invention, the corner hinge 610 shown in the corner assembly 600, may be positioned in any of the four intersecting joints along the side of a suitcase (i.e., top-left, top-right, bottom-left, bottom-right). While the side panels shown only reflect a primary board 602, the remaining components of the side panels were intentionally left out of the Figure for simplification, and would normally be provided in a practical and/or tangible embodiment of the present invention.

The corner hinge 610 generally comprises a first hinge panel 615, a second hinge panel 617, and a spine 616 which serves as an axis about which the first and second hinge panels may rotate. In many embodiments, the spine 616 is constructed similar to a a door hinge in that a pin may be placed through commonly aligned channels in both the first hinge panel 615 and the second hinge panel 617, forming a rotatable axis.

The hinge 610 also generally comprises a ring 614 or other protrusion, which extends from the spine 616. The ring 614 may comprise any structure suitable to allow a user to operate the hinge as described herein. In many embodiments, the hinge 610 comprises a means 612 for attaching to the side panels. In one embodiment, the means for attaching 612 may comprise any of a screw, bolt, rivet, nail, staple, chemical composition (e.g., glue or epoxy) or similar fastening mechanism. The nature of the means for attaching 612 generally provides an angled flange in addition to the actual fastening means, whereby the angled flange generally allows for each of the side panels to remain perpendicular to one another. As shown in the Figure, the hinge 610 generally attaches to the front surface of each of the side panels, and affixes to the primary board 602 of each side panel.

Figure 7:
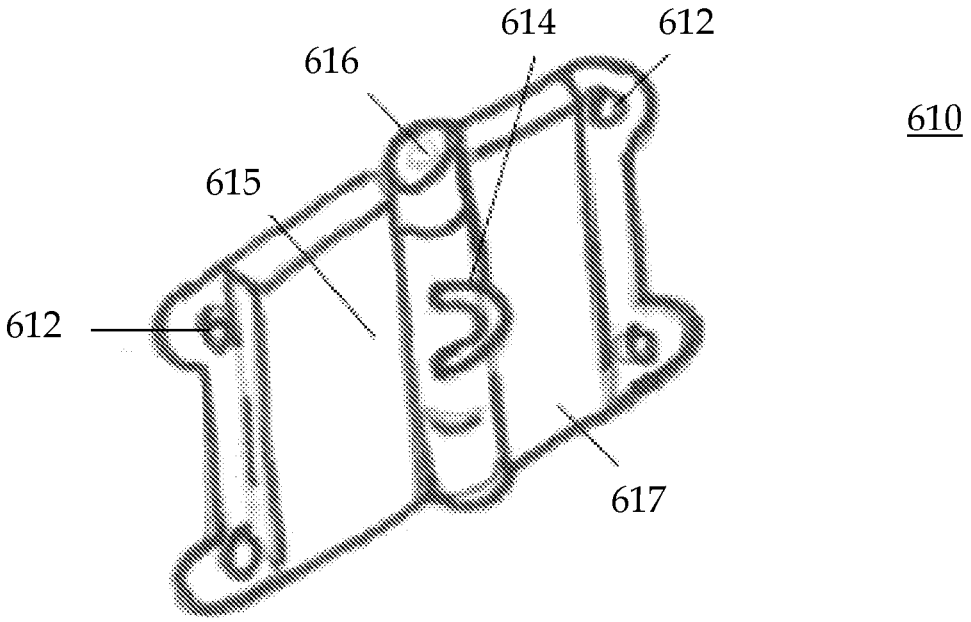
FIG. 7 depicts a perspective view of a corner hinge in accordance with one embodiment of the present invention.

FIG. 7 depicts a perspective view of a corner hinge in accordance with one embodiment of the present invention. In many embodiments, the hinge 610 is generally provided with a spring mechanism (not shown) for keeping the hinge 610 in a substantially planar position when no force is acting thereon. That is, the hinge panels 615 and 617 are generally parallel to one another on the same plane in a relaxed state. In one embodiment, the spring mechanism may comprise a coil spring embedded within the spine 616 or on a back surface of the hinge. In alternative embodiments, other tension devices, such as elastics, may be utilized to provide such force required to keep the hinge in the open planar position.

Figure 8:
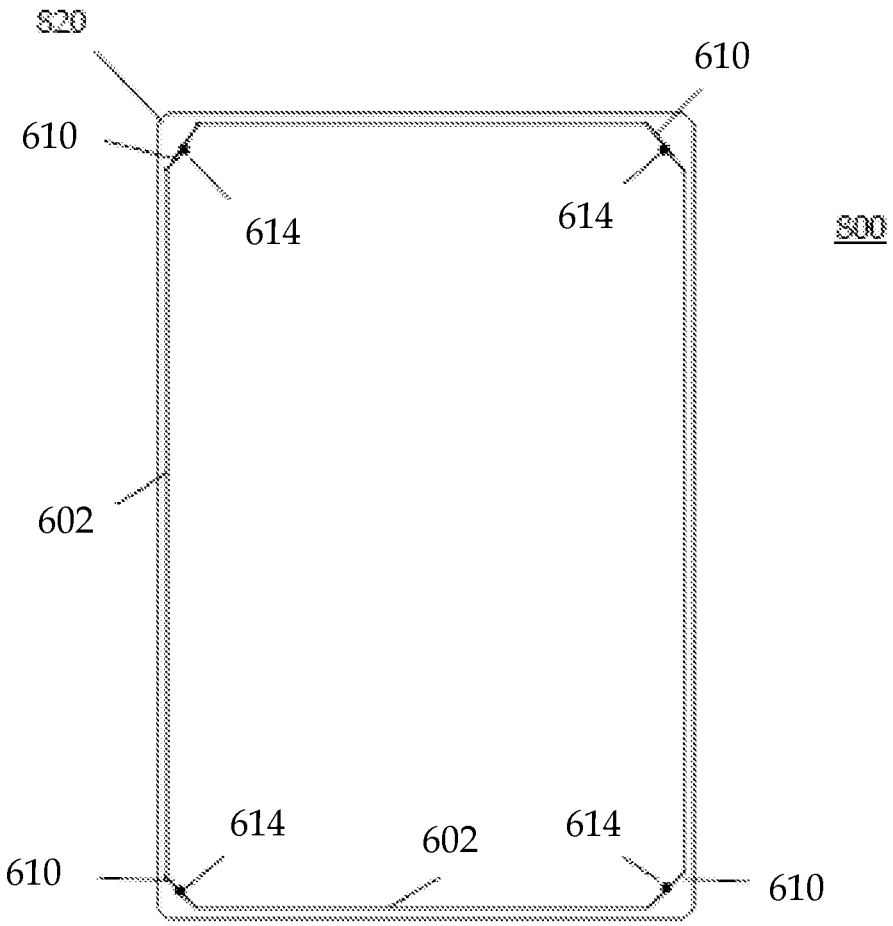
FIG. 8 depicts a top view of the interior of a suitcase in accordance with one embodiment of the present invention.

FIG. 8 depicts a top view of the interior of a suitcase in accordance with one embodiment of the present invention. The suitcase 800 generally provides a substantially rectangular cross-section having a plurality of side panels 602 aligning the side walls of the suitcase, and a plurality of hinges 610 provided at each of the intersection corners 820 thereof. As shown in the Figure, when the hinges 610 are provided in an open planar position, the side panels are held in place, and specifically, the tensile forces provided on the side panels by each of the hinges 610 hold the primary board of each side panel in place. As described above, where the primary board is substantially held in place and where each of the side flaps of a side panel are held in place by the structural elements of the suitcase 800, the side panels cannot operate to go from a closed to open position.

Figure 9:
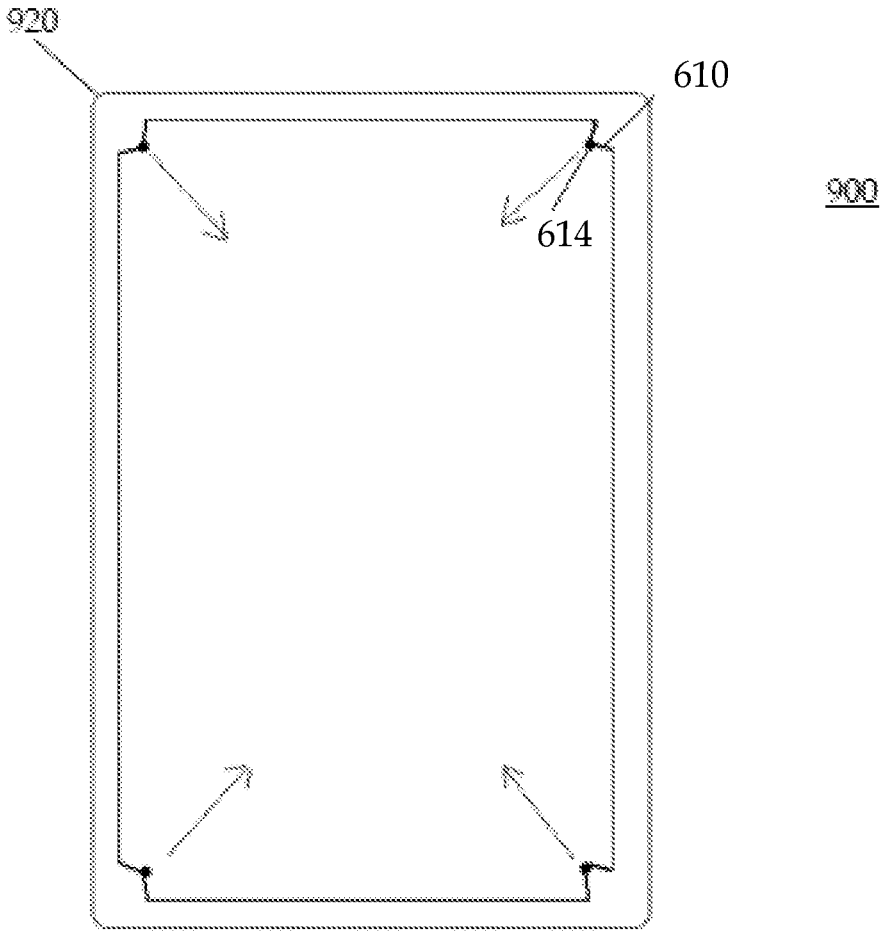
FIG. 9 depicts a top view of the interior of a suitcase having retracted corner hinges in accordance with one embodiment of the present invention.

FIG. 9 depicts a top view of the interior of a suitcase having retracted corner hinges in accordance with one embodiment of the present invention. In one embodiment, in order to allow the primary board of each of the side panels to move in a lateral direction, the hinges 610 must be retracted about the spine, generally by pulling the ring towards a center of the suitcase 900.

In many embodiments, in order for the side panels to operate properly, each of the rings 614 of each of the hinges 610 may be pulled at substantially the same time, thus relieving the forces on all the side panels. In many embodiments, a hinge retraction means (not shown) may be provided to accommodate such task. In one embodiment, the hinge retraction means comprises a plural of strings, each affixed to a different ring, which may be pulled simultaneously. In another embodiment, the hinge retraction means comprises a pair of cloth or fabric handles, each of each handle affixed to a pair of hinges. In some embodiments, handles may be part of integrated pockets or pouches within the suitcase. In yet another embodiment, the hinge retraction means comprises a fabric or cloth affixed to all of the rings, for example, if shaped in an x-type pattern.

Figure 10:
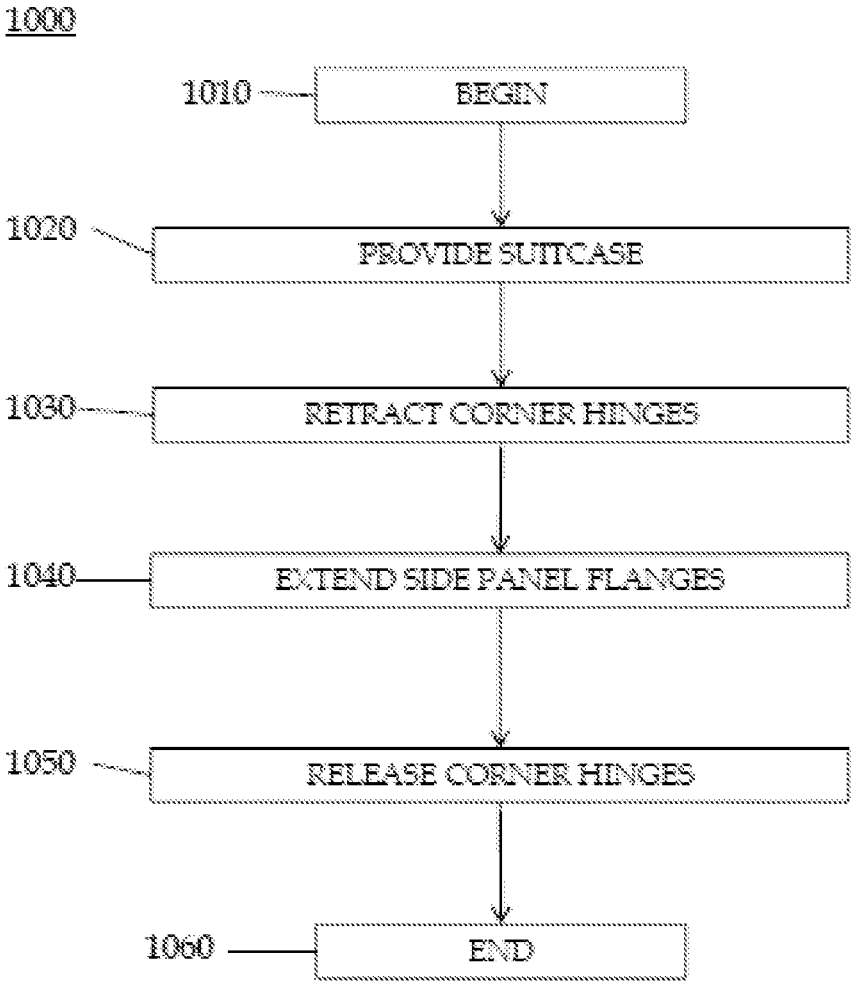
FIG. 10 depicts a flowchart of a method for extending a suitcase in accordance with one embodiment of the present invention.

FIG. 10 depicts a flowchart of a method for extending a suitcase in accordance with one embodiment of the present invention. The method 1000 begins at step 1010. At step 1020, a suitcase having a front portion, a back portion, and an expandable portion defined by a top, a first side, a second side and a bottom of the suitcase, is provided. In many embodiments, the expandable portion comprises a plurality of side panels, each side panel having a primary board, a first side board and a side flap. Generally, the suitcase further comprises a plurality of hinges disposed at an intersection of each of the side panels, each hinge comprising a first hinge panel attached to one of the side panels and a second hinge panel connected to the other side panel, wherein the hinge is spring-loaded to remain in a substantially planar position in a rested state.

At step 1030, a user retracts each of the corner hinges. Generally, a user may pull a ring on a spine of each hinge towards the center of the suitcase to retract each hinge. In some embodiments, the user may utilize a hinge retraction means for each hinge. While the hinges are retracted, at step 1040, the user may extend each of the side flaps of each of the side panels to create the expanded portion of the suitcase. In many embodiments, the user may be able to pull on a structural component of the suitcase, such as an end of the front portion of the suitcase to facilitate the expansion.

In an exemplary embodiment, while the user is retracting the hinges with one hand, for example, by pulling on two handles where each handle is connected to two hinges, the user may use the other hand two push downward on an interior surface of the back portion of the suitcase to extend each of the side flaps of the side panels. Where the suitcase is positioned on a bed, table or other rigid surface, the same opposing force may be achieved by putting a hand on the inner surface of the back portion of the suitcase, and pulling up with the other hand that is also holding the handles that retract each of the hinges.

In certain embodiments, where each side panel has a first and second side flap, the user may have to doubly expand the suitcase by extending each of the second side flaps. Similar to the steps described above, once the first side flaps are extended, the user may extend the second side flaps in a similar fashion. For example, by holding the same set of handles to retract the hinges, the user may grab the front portion of the suitcase and pull up to extend the second side flaps. In certain embodiments, a second set of handles may be provided to facilitate the second extension, where the second set of handles are connected to the front portion of the suitcase, and the user may grab them to achieve the extension of the second side flaps.

While the extension of the first and second side flaps may be achieved in two separate expansion phases, it is not uncommon in such embodiments for the user to accomplish the extension of both the first and second side flaps of each side panel with a single motion. However, in certain embodiments, only one of the two side flaps may be extended if full expansion is not desired.

Once the user has expanded all of the desired side flaps, as step 1050, the user may release the corner hinges. The resulting suitcase will be fully expanded in accordance with embodiments of the present invention. The method 1000 ends at step 1060.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. An expandable suitcase comprising:

a front portion;

a back portion;

a plurality of side panels, each side panel aligning with one of a top, a bottom, a first side, and a second side of the suitcase, and each side panel having a primary board, at least a first side board rotatably connected to the primary board about a common edge therewith, and a first side flap rotatably connected to the first side board about a common edge opposing the common edge with the primary board; and a plurality of hinges disposed at an intersection of two side panels, each hinge comprising a first hinge panel attached to one of the side panels and a second hinge panel connected to the other side panel, each hinge comprising a spine, wherein the spine provides an axis about which the first and second hinge panels may rotate, each spine of each of the hinges comprising a ring protruding therefrom, wherein the hinge remains in a substantially planar position in a rested state.

2. The expandable suitcase of claim 1, wherein each side panel further comprises:

a second side board rotatably connected to the primary board about a common edge opposing the common edge between the primary board and the first side board, and a second side flap rotatably connected to the second side board about a common edge opposing the common edge with the primary board.

3. The expandable suitcase of claim 1, wherein each the front portion and the back portion comprise one of polycarbonate, acrylonitrile butadiene styrene, ethylene vinyl acetate, or combinations thereof.

4. The expandable suitcase of claim 1, wherein each side panel comprises a primary support structure, a body material and a covering for exposure to an inside surface of the suitcase.

5. The expandable suitcase of claim 4, wherein the primary support structure comprises a thermoplastic material formed into a honeycomb shape.

6. The expandable suitcase of claim 4, wherein the body material comprises a fabric.

7. The expandable suitcase of claim 1, wherein each of the side panels has the first side flap substantially affixed to the back portion of the suitcase.

8. An expandable suitcase comprising:

a front portion;

a back portion;

a plurality of side panels, each side panel aligning with one of a top, a bottom, a first side, and a second side of the suitcase, and each side panel comprising:

a primary board;

at least a first side board rotatably connected to the primary board about a common edge therewith, and a first side flap rotatably connected to the first side board about a common edge opposing the common edge with the primary board; and a second side board rotatably connected to the primary board about a common edge opposing the common edge between the primary board and the first side board, and a second side flap rotatably connected to the second side board about a common edge opposing the common edge with the primary board;

a plurality of hinges disposed at an intersection of two side panels, each hinge comprising a first hinge panel attached to one of the side panels, a second hinge panel connected to the other side panel, a spine for providing an axis about which the first and second hinge panels may rotate, wherein the each spine of the hinges comprises a ring protruding therefrom.

9. The expandable suitcase of claim 8, wherein each the front portion and the back portion comprise one of polycarbonate, acrylonitrile butadiene styrene, ethylene vinyl acetate, or combinations thereof.

10. The expandable suitcase of claim 8, wherein each side panel comprises a primary support structure, a body material and a covering for exposure to an inside surface of the suitcase.

11. The expandable suitcase of claim 10, wherein the primary support structure comprises a thermoplastic material formed into a honeycomb shape.

12. The expandable suitcase of claim 10, wherein the body material comprises a fabric.

13. The expandable suitcase of claim 8, wherein each of the side panels has the first side flap substantially affixed to the back portion of the suitcase.

14. A method of expanding a suitcase comprising:

providing an expandable suitcase, the expandable suitcase comprising:

a front portion;

a back portion;

a plurality of side panels, each side panel aligning with one of a top, a bottom, a first side, and a second side of the suitcase, and each side panel having a primary board, at least a first side board rotatably connected to the primary board about a common edge therewith, and a first side flap rotatably connected to the first side board about a common edge opposing the common edge with the primary board, each side panel further comprising a second side board rotatably connected to the primary board about a common edge opposing the common edge between the primary board and the first side board, and a second side flap rotatably connected to the second side board about a common edge opposing the common edge with the primary board; and a plurality of hinges disposed at an intersection of two side panels, each hinge comprising a first hinge panel attached to one of the side panels and a second hinge panel connected to the other side panel, wherein the hinge remains in a substantially planar position in a rested state;

retracting each of the plurality of hinges towards a center of the suitcase;

extending each of the first side flaps of each of the plurality of side panels; and releasing the plurality of hinges; and extending each of the second side flaps of each of the plurality of side panel while each of the plurality of hinges is retracted.

* * * * *

UNITED STATES PATENT AND TRADEMARK OFFICE

CERTIFICATE OF CORRECTION

PATENT NO. : 8,820,498 B2
APPLICATION NO. : 13/311658
DATED : September 2, 2014
INVENTOR(S) : Dror Benshetrit et al.

It is certified that error appears in the above-identified patent and that said Letters Patent is hereby corrected as shown below:

In the Claims:

At column 9, claim no. 8, line no. 29, after the word spine insert -- of each --.

Signed and Sealed this
Thirteenth Day of January, 2015

Michelle K. Lee

Michelle K. Lee
*Deputy Director of the United States Patent and Trademark Office*